US006416198B1

(12) United States Patent
Vanderschuit

(10) Patent No.: US 6,416,198 B1
(45) Date of Patent: Jul. 9, 2002

(54) ILLUMINATABLE BEVERAGE ACCESSORY DEVICE

(76) Inventor: Carl R. Vanderschuit, 751 Turquoise, San Diego, CA (US) 92109

( * ) Notice: Subject to any disclaimer, the term of this patent is extended or adjusted under 35 U.S.C. 154(b) by 0 days.

(21) Appl. No.: 09/627,961

(22) Filed: Jul. 28, 2000

Related U.S. Application Data

(60) Provisional application No. 60/154,424, filed on Sep. 17, 1999.

(51) Int. Cl.[7] ..... F21V 33/00

(52) U.S. Cl. ..... 362/101; 362/318; 362/253; 362/394; 362/205; 362/158

(58) Field of Search ..... 362/101, 154, 362/318, 253, 394, 205, 184, 158

(56) References Cited

U.S. PATENT DOCUMENTS 1,107,645 A * 8/1914 Benedict
3,818,208 A * 6/1974 Kahl ..... 240/604
4,409,644 A * 10/1983 Axton et al. ..... 362/200
5,070,437 A * 12/1991 Roberts, Sr. ..... 362/158
5,463,537 A * 10/1995 Trattner et al. ..... 362/103
5,697,182 A * 12/1997 Rodgers ..... 43/17.1
5,860,724 A 1/1999 Cheng ..... 62/34
5,903,212 A 5/1999 Rodgers ..... 340/309.4

* cited by examiner

*Primary Examiner*—Sandra O'Shea
*Assistant Examiner*—Jacob Y. Choi
(74) *Attorney, Agent, or Firm*—Frank G. Morkunas

(57) ABSTRACT

An illuminatable beverage accessory device having at least one light; at least one power source; a cartridge having a chamber for the light and a chamber for the power source which is either adapted to permit the power source, upon suitable application of external force, to reciprocally translate from one side (to turn the light on) to the other side (to turn the light off) or which uses a push-button switch device; and a housing having a cavity therein covering the cartridge. It is preferably constructed in a water-tight fashion to permit its use and illumination in a liquid. It is also preferably constructed to simulated a partially melted ice cube or ice berg and is adapted to house and display messages of various three-dimensional objects from within.

44 Claims, 3 Drawing Sheets

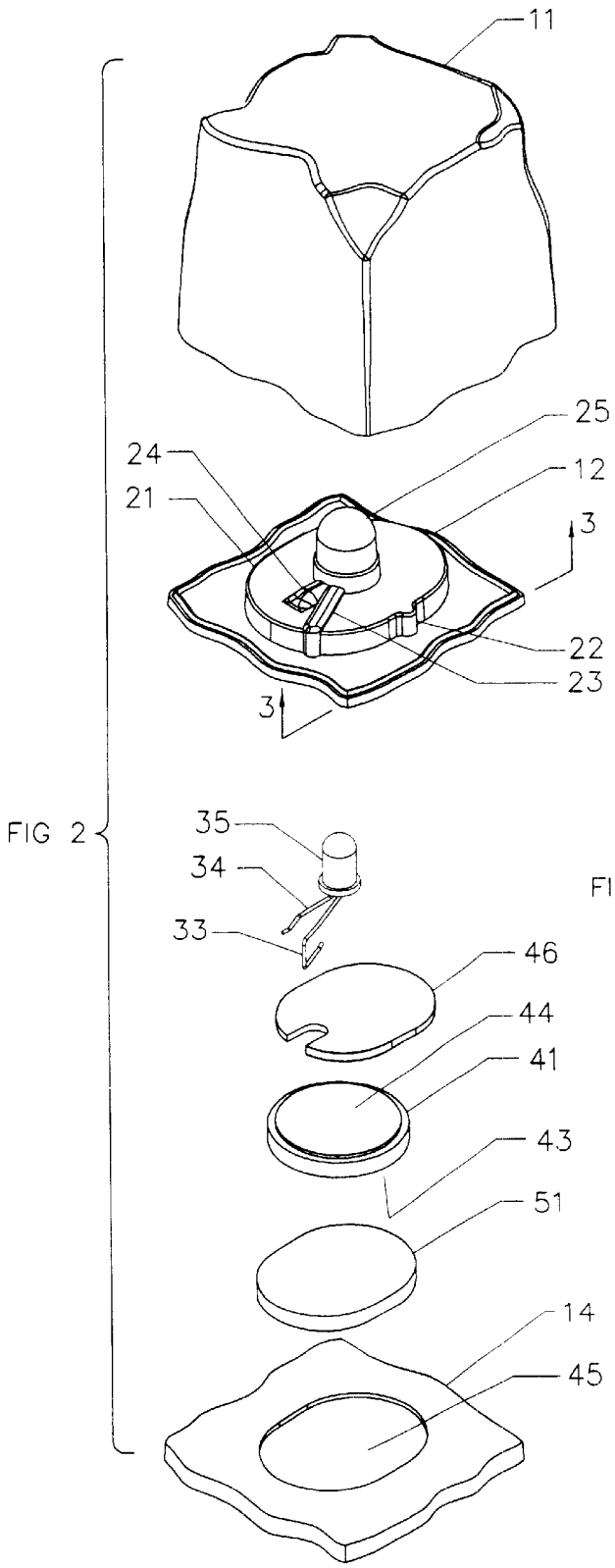
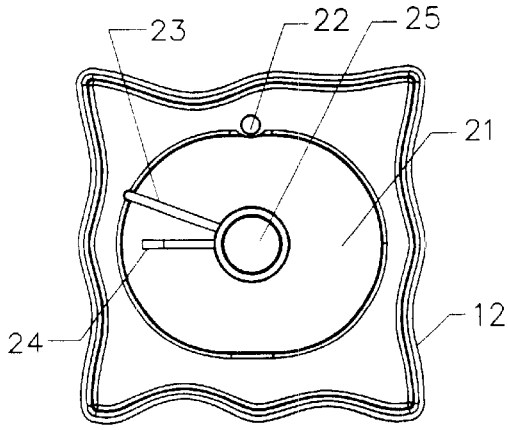
FIG 3
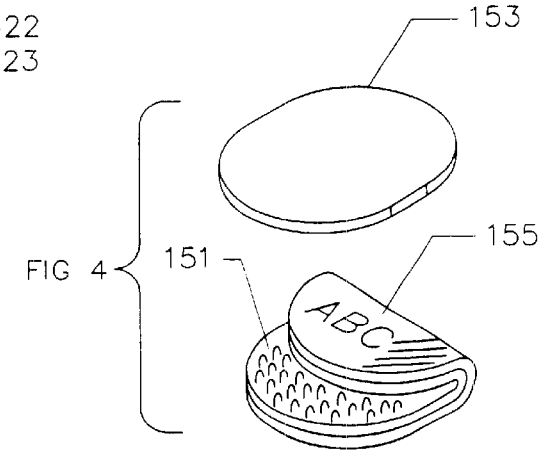
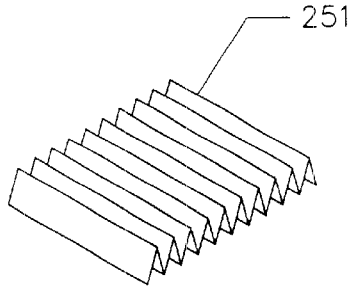
FIG 5

ILLUMINATABLE BEVERAGE ACCESSORY DEVICE

CROSS REFERENCES TO RELATED APPLICATIONS

This application is a non-provisional application of my co-pending U.S. provisional application, application No. 60/154,424, filed on Sep. 17, 1999.

STATEMENT REGARDING FEDERALLY-SPONSORED RESEARCH OR DEVELOPMENT

Not applicable

BACKGROUND OF THE INVENTION

This present invention relates to an illuminatable novelty-related accessory for use in containers filled with a liquid substance; i.e. drinks, and is an improvement over prior novelty-related devices.

Currently there are several prior art novelty-related devices resembling an ice cube. These are either complex in structure or in use or both. U.S. Pat. No. 5,860,724 issued to Cheng describes a luminescent light emitter shaped like an ice cube having several chambers within, each filled with chemicals which, when mixed, emit light. Though suited for the intended purpose, it is of complex construction, requiring chemicals, and is a relative burden to use. U.S. Pat. No. 5,902,212 issued to Rodgers is even more complex. It is motion-sensitive. The device is powered by any motion through a motion-responsive ball-switch within. After the device is illuminated, a timer controls the duration of light emission. This device is relatively easy to use but is extremely complex in structure. A need still exists for novelty items such as illuminatable beverage accessories or mood enhancers to provide visual pleasure to one's other sensory pleasures while relaxing consuming a beverage; particularly, those novelty items resembling an ice cube for use in a drink.

Accordingly, several objects and advantages of my invention are to:

a. provide an easy-to-use illuminatable novelty device to enhance the atmosphere of an occasion;

b. to enhance one's enjoyment while consuming a beverage;

c. provide for all to use an inexpensive pleasurable novelty device;

d. create a unique promotional novelty device adapted to convey messages to users; and e. assist in heating or cooling a beverage.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates an illuminatable beverage accessory device having at least one light; at least one power source; a cartridge having a chamber for the light and a chamber for the power source which is either adapted to permit the power source, upon suitable application of external force, to reciprocally translate from one side (to turn the light on) to the other side (to turn the light off) or which uses a push-button switch device; and a housing having a cavity therein covering the cartridge. A lid is secured to the housing in a water-tight fashion. The lid and housing may be of a single-piece construction or may be two separate elements. A chamber in the lid houses a support for the power source to prevent undesired movement to the 'on' or 'off' mode. This chamber may have a transparent bottom to display messages. The housing may be transparent, translucent, or opaque, or any combination thereon. In cases where there is a cavity in the housing and the housing has transparency, a display mechanism is connected to one or more inside walls of the housing and is adapted to receive and display plaques conveying messages.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 2 is an exploded view of the beverage accessory.

FIG. 3 is planar view of a portion of the beverage accessory as taken on line 3—3 of FIG. 2.

FIG. 4 is an exploded detail view of a support member for the power source of the beverage accessory.

FIG. 5 is a detailed view of another embodiment of a support member for the power source of the beverage accessory.

DETAILED DESCRIPTION OF THE INVENTION

Figure 1:
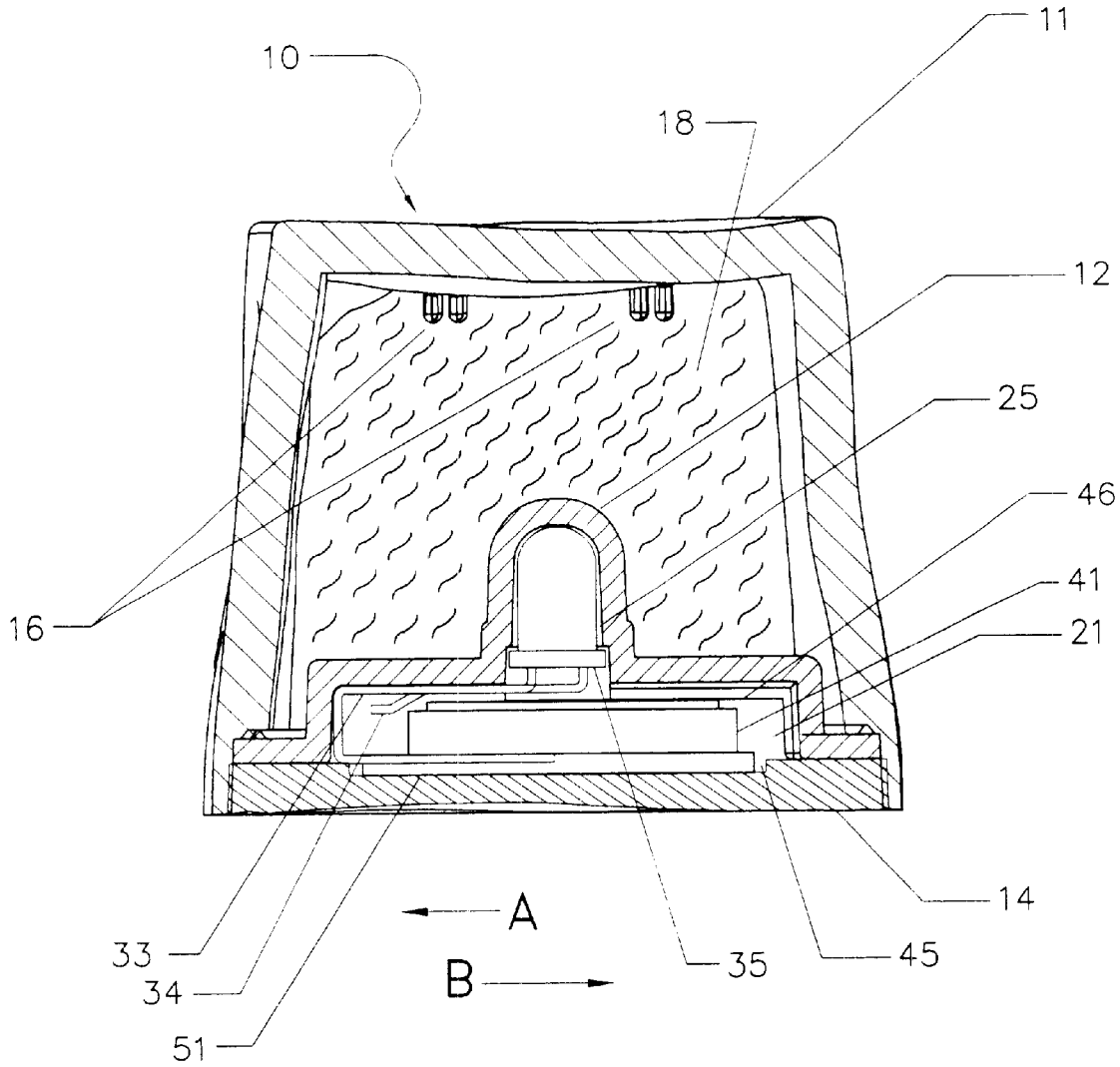
FIG. 1 is cross-section elevation view of the beverage accessory.

Referring now to the drawings in detail and in particular to FIG. 1, reference character 10 generally designates a novelty item beverage accessory device constructed in accordance with a preferred embodiment of the present invention. A housing 11 rests on a lid 14. Within the housing 11 seated on the lid 14 is a cartridge 12. A cavity is, though need not be, formed above the cartridge 12. A cavity is preferred but the space above the cartridge 12 also may be part of the inner housing itself—a single-piece or of a solid construction fitted onto or be a part of the cartridge 12. This solid inner housing may be transparent or translucent and/or comprise any one or more colors or tints or shades.

The cartridge 12 can be fixedly sealed to the lid 14 and each, the cartridge 12 and the lid 14, can be fixedly sealed to the housing 11 thereby creating a water-tight integrity for the beverage accessory device 10. It must be understood, however, that any one or more of these parts (that is, the housing 11, the cartridge 12, and the lid 14) may be removably attached to any one or all of the other parts, or fixedly attached to any one or all of the others, or in any combination thereof. For maintaining water-tight integrity, a fixed seal is preferred.

Reference is now made to FIGS. 1–3. Within the cartridge 11 is a light-source chamber 25, a power-source chamber 21, a detent 22 or similar structure suited for the intended purpose of restricting the (unwanted) movement of the power-source 41 (having a negative terminal or cathode 44 and a positive terminal or anode 43) within the power-source chamber 21, and wire lead channels 23, 24 adapted to receive the respective wire leads 33, 34 from the light source 35. The light source 35 seats into the light-source chamber 25. Its wire leads 33, 34 seat into the respective wire lead channels 23, 24 of the underside of the cartridge 12. The power source 41 is seated into the power-source chamber 21 directly below the light source 35. The power-source chamber 21 is sized such that the power source 41 may slide from one side to another side as depicted by direction arrows A and B in FIG. 1 (for reference purposes only, and not by way of limitation, this figures depicts a right to left translation of the power source 41 and in this vein, the power-source chamber 21 is slightly longer than the length of the power source 41). Side to side length of the power-source chamber 21 is slightly less than the length of the power source 41 to provide the clearance necessary to permit movement in directions A and B when desired. Undesired movement within the power-source chamber 21 of the power source 41 is restricted by placement of a detent 22 within the power-source chamber 21, or similar structure suited for the intended purpose such as, but not limited to a nub, a bias member, a pin, and the like. Those skilled in the art, however, will recognize that any restricting-type mechanism suited for the intended purposes may be employed and are not limited to these forms of restricting-type mechanisms described above.

One wire lead (for example purposes only, and not by way of limitation, it is wire lead 33) extends from the light source 35 around the inner perimeter of the power-source chamber 21 to the bottom of the power source 41 as follows: from upper chamber wall to the left side wall then down to the bottom chamber wall and then to the right. This wire lead 33 is in continuous communication with one terminal of the power source (for example purposes only, and not by way of limitation, the wire lead 33 communicates with the positive terminal on the bottom of the power source 41). Below the power source 41 and inside the lid chamber 45 is a bias member 51. The bias member 51 is seated in the lid chamber 45 and is adapted to apply force on and/or support to the power source 41 such that the power source 41 does not and cannot easily move or translate from side to side (directions of arrows A or B) unless external force is applied to overcome the force and support being applied by the bias member 51 to then cause such movement.

Wire lead 34 from light source 35 in this example is the negative lead and seats in lead channel 34 of the underside of the cartridge 21. As illustrated in FIG. 1, this wire lead 34 is positioned well away from contact with the power source 41 when power source 41 is, by way of this example only, in the full right side position (moved fully in the direction of arrow B). This wire lead 34 is slightly downward angled left of center such that, when the power source 41 is slid in the direction of arrow A, the top side (in this example, the negative terminal) of the power source 41 contacts this wire lead 34 thereby completing the circuit causing the light to power 'on'. When the power source is slid sufficiently in the direction of arrow B, contact between the wire lead 34 and the negative terminal of the power source 41 is broken and light emission from the light source 35 will terminate. To prevent undesired contact between wire lead 33 (positive in this example) and the negative terminal of the power source (top in this example) and undesired contact between wire lead 34 (negative lead in this example) and the negative terminal of the power source 41 (top in this example) an insulator has been inserted on the top (as viewed from the perception of FIG. 1) of the power-source chamber 21 between the two wire leads 33, 34 and the top of the power source 41. The insulator 46, however, should extend approximately up to wire lead 33 at a point where it is desired that the wire lead 33 come in contact with the top of the power 41 when the power source 41 is caused to move in direction A (in this example, and not by way of limitation, this point is approximately where the downward angling of wire lead 33 begins).

The beverage accessory device is preferably formed from biologically safe material, such as, but not limited to, polymers or any other material suited for the intended purpose which has properties suitable for placing it in contact with a material that is to be ingested and falls under the Food and Drug Administration food-contact grade properties. The beverage accessory device also could be manufactured from, or filled with, a material capable of maintaining cold or heat if the beverage accessory device is cooled or heated as the case may be. As such, the beverage accessory device could impart such properties to a drink if desired. As stated earlier, the housing 11 may be hollow; that is, have a cavity within and above the cartridge 12. In such cases, the cavity may be filled with a filler 18 such as, but not limited to, water, jell, powder, metals, heat-retaining materials, cold-retaining materials, and the like, all may be either colored or clear or translucent or any combination thereof. Depending on the material used, such filler 18, if frozen or heated, could impart greater cooling or heating properties, respectively, than a solid housing 11. For cooling and heating properties, any commercially available material bearing cold-retaining or heat-retaining properties will suffice, such as, but not limited to, materials generally used in reusable ice-packs and heating pads. Those skilled in the art, however, will recognize that any filler suited for the intended purposes may be employed and are not limited to these forms of fillers described above.

Having a solid inner housing 11 or a filler 18 within creates a negative buoyancy to the beverage accessory device. Adjusting such combinations of filler 18 and/or solid inner housing 11 or retaining an unused cavity would generally create a positive buoyancy for the beverage accessory device. Since the beverage accessory device could be used as a novelty ice cube, its outer features could simulate the contours and somewhat curved corners of a real ice cube. It could resemble that of a melted or partially melted or melting ice cube complete with a convoluted exterior surface. Shape, for this purpose, would enhance the pleasure of its use. Indicia, external or internal, could be displayed by the beverage accessory device. Such indicia could impart holiday themes, professional themes, promotional themes, sports related themes, and the like. Those skilled in the art, however, will recognize that any theme suited for the intended purposes may be employed and are not limited to these types of themes described above.

In an embodiment where the lid chamber 45 is somewhat or completely transparent, the portion of the bias member 51 which is exposed to the lid chamber 45 (bottom of bias member 51 for example) could contain any indicia which, as a result of the transparency of the lid chamber 45, is exposed to outside viewers. As above, such indicia also could impart holiday themes, professional themes, promotional themes, sports related themes, and the like. This bottom of the bias member 51 could be of a glossy surface, a non-glossy surface, smooth, or textured, or any combination thereof.

In an embodiment where the inner housing 11 is a cavity, a display mechanism 16 is connected to any one or more side walls or the top of the housing 11. The display mechanism is adapted to receive and hold, but is not limited to, a display placard, plaque, card, any two- or three-dimensional objects, and the like, or any combination thereof which may convey a message, project an image or impression, or to merely bring entertainment to the user of the beverage accessory device; to the user. Any display mechanism suited for the intended purpose will suffice, including, but not limited to, clips, slots, hooks, rollers, tabs, and the like. Those skilled in the art, however, will recognize that any display mechanism suited for the intended purposes may be employed and are not limited to these forms of display mechanisms described above.

The light source 35 can be any source which can illuminate the beverage accessory device and preferably the surrounding environment into which the beverage accessory device is placed; into a drink (floating or not), in a planter, in a fish bowl, on a dinner table, at a picnic, and the like. Any light source 35 suited for the intended purpose will suffice, such as, but not limited to light-emitting diodes (LED's), fiber optics, halogen, incandescent, laser, fluorescent, magnetic, and the like. It is preferred, however, that the light source 35 not impart excessive or undesired heat or temperature to the beverage accessory device and the surrounding liquid or drink. An LED is preferred, however, those skilled in the art will recognize that any light source mechanism suited for the intended purposes may be employed and are not limited to these forms of light source mechanisms described above.

The power source 41 contemplates any means of providing energy to the light source 35 to thereby cause the light source 35 to emit light. An power source 41 suited for the intended purpose will suffice including, but not limited to, renewable batteries, rechargeable batteries, disposable batteries, power cells, and the like. If rechargeable, such power source 41 should be rechargeable by solar, magnetic, electrical, and chemical means, and the like or any combination thereof. The preferred embodiment directs that the power source 41 be fully contained within the beverage accessory device and not to be in contact with its external environment. Those skilled in the art will recognize, however, that any power source mechanism suited for the intended purposes may be employed and are not limited to these forms of power source mechanisms.

The bias member 51 may be comprised of any suitable material or structure suited for the intended purpose such as, but not limited to a spring, a resilient pad, a single piece of VELCRO material, a foam pad, a corrugated plate, a spring plate, and the like or any combination thereof. In the preferred embodiment a foam-like member 51 is used. A typical foam-like member may be, but is not limited to, rubber, vinyl, polyethylene polyester, styrofoam, and the like, or any combination thereof. A single piece of VELCRO material 151 (that is, the hook side of a hook-and-loop VELCRO, or the loop side of a hook-and-loop VELCRO) may also be used (see FIG. 4). In such case, a cover 153 would be placed on the VELCRO portion of this material. The VELCRO portions give this element the spring-like quality necessary to apply pressure or force to the power source 41 to thereby, in the process, provide support for the power source 41 within the power-source chamber 21 and prevent unwanted movement. Printed indicia, as explained above, would be on the reverse side 155. FIG. 5 illustrates another type of bias member, that of a corrugated plate-like member 251. What is necessary for the support is application of upward force on the power source 41 to prevent it from moving when movement is not desired. Those skilled in the art will recognize, however, that any force applying mechanisms suited for the intended purposes may be employed and are not limited to these forms of bias member mechanisms.

Once the beverage accessory device is so constructed, a user would pick it up and strike an edge (for illustration purposes only, and not by way of limitation, we will adhere to relative positions of FIG. 1). To illuminate the beverage accessory device, the user would move the beverage accessory device in the direction of arrow A and strike the left side of the beverage accessory device on any suitable somewhat rigid surface. The force of this blow causes the power source 41 to slide from its right-most position, in the direction of arrow B to the left and cause the negative terminal of the power source 41 to contact the negative lead wire 33. Light thereupon is emitted. To turn off the light, the user strikes the right side of the beverage accessory device (direction of arrow B) causing the power source 41 to return to the right inside the power-source chamber 21. Contact between the negative wire lead 33 and the negative terminal of the power source 41 is broken and the light thereupon extinguished. Those skilled in the art will recognize, however, that multiple switch mechanisms suited for the intended purposes, such as magnetic switches, mechanical switches, and electrical switches, and the like, may be employed and are not limited to this translating-type switch mechanism.

FIGS. 6–10 illustrate a conventional 'push-button' type power switch device 63. What has been described before with regard to the beverage accessory device which bears the same reference numerals for FIGS. 6–10 apply to this embodiment and are incorporated by reference. What distinguishes this embodiment from the previously discussed embodiment is the switch-facilitating mechanism comprising a mechanical switch device 63, on a foundation member 61, which is seated into a ledge 65 in the lid chamber 45. Any conventional switch device 63 will suffice. For this embodiment, however, a 'push-button' style is preferred. Here the positive lead wire 33 from the light source 35 is hard-wired into the foundation member 61 and connected to the switch device 63. Reference point 73 is the solder point for the positive lead wire 33 to the foundation member 61; reference point 74 is the solder point for the negative lead wire 34 to a clip-like member 84 which generally maintains constant contact with the power source 41. The power source 41 is held firmly in place thereat and, when switch device 63 is switched on or off, the light source 35 goes on or off as the case may be.

The clip-like member 84 is configured such that it seats firmly on the power source 41. It must be understood, however, that though the negative wire lead 34 is shown to be in constant contact with the power source 41 via the clip-like member 84, this configuration may be reversed and the positive wire lead 33 may be in constant contact with the power source 41 via the clip-like member 84 instead.

Figure 6:
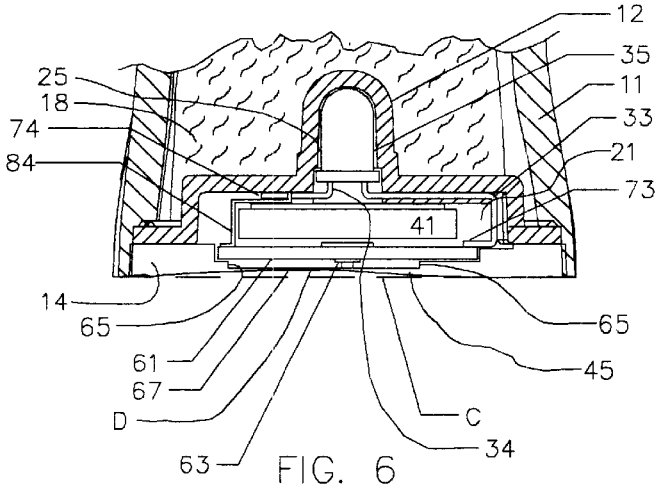
FIG. 6 is a detailed partial view of another embodiment of the beverage accessory.
Figure 8:
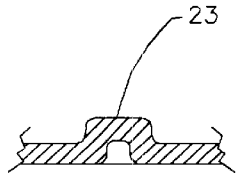
FIG. 8 is a detailed view of a lead chamber in the beverage accessory as taken on line 8—8 of FIG. 7.
Figure 7:
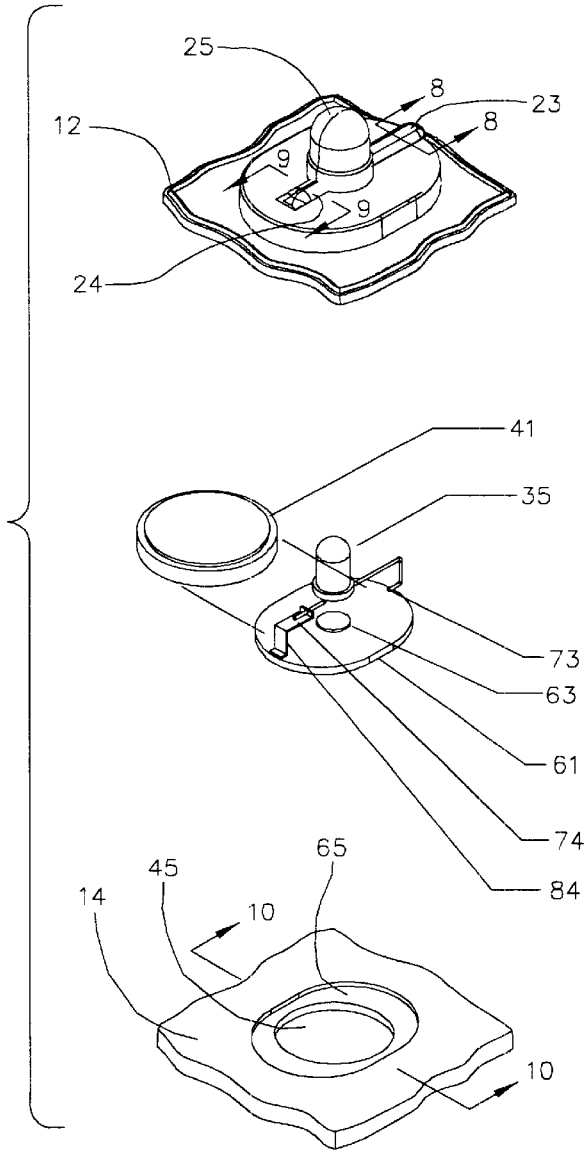
FIG. 7 is an exploded view of the second embodiment of the beverage accessory.
Figure 9:
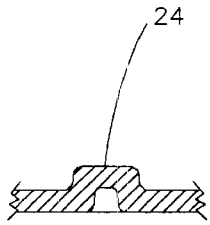
FIG. 9 is a detailed view of another lead chamber in the beverage accessory as taken on line 9—9 of FIG. 7.
Figure 10:
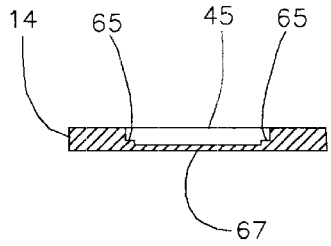
FIG. 10 is a detailed view the lid as taken on line 10—10 of FIG. 7.

The lid 14 in this embodiment has a lid chamber 45 with a step or ledge 65. As was described, the foundation member 61, with switch device 63 in place, seats into the lid chamber 45 on the ledge 65. The switch device 63 is adjacent to the bottom of the lid chamber 45. The bottom of the lid chamber 45 here is relatively thin (or membrane-like 67) such that it flexes to the touch and exertion of some external pressure. The purpose of this resiliency and flexibility is to permit a user to contact the internal switch device 63 from the outside and to thereby switch the light source 35 'on' or 'off'. FIG. 6, reference character C (represented by phantom line) illustrates the position of the thin layer 67 in its normal position; reference character D illustrates its position after external pressure is exerted on the thin layer 67.

The present disclosure includes that contained in the present claims as well as that of the foregoing description. As can be gleaned, the device has multiple functions. If constructed of water-tight integrity, it can be place into liquids. Whether or not of water-tight integrity, it can be used to enhance moods, provide visual pleasure or serenity, or provide numerous novelty-related results. If appropriate fillers are used, it can also impart heating or cooling properties to its adjacent environment. Its external shape also can be altered to facilitate a particular use and it can provide and display messages to others. The principal use envisioned, however, is that of a simulated ice cube or ice berg, of any size and shape, which is immersible in a liquid (to sink or float, depending on how constructed) and is illuminatable at will by a user.

Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiments illustrated, but by the appended claims and their legal equivalents.

The invention claimed is:

1. An illuminatable beverage accessory device comprising:

a. at least one light source;

b. at least one power source switchably connected to said light source;

c. a cartridge having a light-source chamber to contain said light source, a power-source chamber below said light-source chamber, and two wire lead channels on the cartridge underside and in communication with said light-source chamber;

d. a lid under said cartridge, said lid having a lid chamber mating with said power-source chamber to thereby contain said power-source therein and further having a power-switching means for powering said at least one light source into and from an on-light mode into and from an off-light mode;

e. a housing covering said cartridge and said lid such that a cavity is defined therein and a water-tight integrity is maintained within said housing; and f. a filler within said cavity, said filler adapted to retain heat when said device is heated.

2. The device as defined in claim 1 wherein said cavity contains a filler being clear, translucent, a plurality of colors, or any combination thereof.

3. The device as defined in claim 1 wherein said cavity contains a filler of sufficient density as to impart a negative buoyancy to said device.

4. The device as defined in claim 1 further comprising holding means for holding display objects, said holding means on an inside surface of said housing.

5. The device as defined in claim 1 wherein said lid chamber has a transparent bottom.

6. The device as defined in claim 1 further comprising a support means seated in said lid chamber for supporting said power source, said support means further comprising indicia on a side exposable to a bottom of said lid chamber.

7. The device as defined in claim 1 wherein said power-switching means comprises said power-source chamber being adapted to permit said power source to reciprocally translate therein from an open light-on mode to a closed light-off mode.

8. The device as defined in claim 7, wherein said power-source chamber further comprises a power-source restrictive means for preventing unintended translation of said power source within said power-source chamber.

9. The device as defined in claim 6 wherein said support means comprises a bias member between the inside surface of said lid and said power source.

10. The device as defined in claim 9 wherein said bias member comprises hook or a loop of a hook-and-loop fastener.

11. The device as defined in claim 9 wherein said bias member comprises a corrugated plate.

12. The device as defined in claim 6 wherein said support means comprises a foam-like resilient member.

13. The device as defined in claim 1 wherein said power-switching means comprises a ledge on said lid chamber, a foundation member seated on said ledge, and a switch device on said foundation member.

14. The device as defined in claim 13 wherein said lid is flexible and, upon application of pressure thereon adjacent to said switch device, said switch device activates said light source into and from an on-light mode and into and from an off-light mode.

15. The device as defined in claim 13 wherein said foundation member is wired to said light source and wherein said foundation member has a clip-like member connected thereto, said clip-like member being in contact with a terminal of said power source.

16. An illuminatable beverage accessory device comprising:

a. at least one light source;

b. at least one power source switchably connected to said light source;

c. a cartridge having a light-source chamber to contain said light source, a power-source chamber below said light-source chamber, and two wire lead channels on the cartridge underside and in communication with said light-source chamber;

d. a lid under said cartridge, said lid having a lid chamber mating with said power-source chamber to thereby contain said power-source therein and further having a power-switching means for powering said at least one light source into and from an on-light mode into and from an off-light mode;

e. a housing covering said cartridge and said lid such that a cavity is defined therein and a water-tight integrity is maintained within said housing; and f. a filler within said cavity, said filler adapted to retain cold when said device is cooled.

17. The device as defined in claim 16 wherein said cavity contains a filler being clear, translucent, a plurality of colors, or any combination thereof.

18. The device as defined in claim 16 wherein said cavity contains a filler of sufficient density as to impart a negative buoyancy to said device.

19. The device as defined in claim 16 further comprising holding means for holding display objects, said holding means on an inside surface of said housing.

20. The device as defined in claim 16 wherein said lid chamber has a transparent bottom.

21. The device as defined in claim 16 further comprising a support means seated in said lid chamber for supporting said power source, said support means further comprising indicia on a side exposable to a bottom of said lid chamber.

22. The device as defined in claim 16 wherein said power-switching means comprises said power-source chamber being adapted to permit said power source to reciprocally translate therein from an open light-on mode to a closed light-off mode.

23. The device as defined in claim 22 wherein said power-source chamber further comprises a power-source restrictive means for preventing unintended translation of said power source within said power-source chamber.

24. The device as defined in claim 21 wherein said support means comprises a bias member between the inside surface of said lid and said power source.

25. The device as defined in claim 24 wherein said bias member comprises hook or a loop of a hook-and-loop fastener.

26. The device as defined in claim 24 wherein said bias member comprises a corrugated plate.

27. The device as defined in claim 21 wherein said support means comprises a foam-like resilient member.

28. The device as defined in claim 16 wherein said power-switching means comprises a ledge on said lid chamber, a foundation member seated on said ledge, and a switch device on said foundation member.

29. The device as defined in claim 28 wherein said lid is flexible and, upon application of pressure thereon adjacent to said switch device, said switch device activates said light source into and from an on-light mode and into and from an off-light mode.

30. The device as defined in claim 28 wherein said foundation member is wired to said light source and wherein said foundation member has a clip-like member connected thereto, said clip-like member being in contact with a terminal of said power source.

31. An illuminatable beverage accessory device comprising:

a. at least one light source;

b. at least one power source switchably connected to said light source;

c. a cartridge having a light-source chamber to contain said light source, a power-source chamber below said light-source chamber, and two wire lead channels on the cartridge underside and in communication with said light-source chamber;

d. a lid under said cartridge, said lid having a lid chamber mating with said power-source chamber to thereby contain said power-source therein and further having a power-switching means for powering said at least one light source into and from an on-light mode into and from an off-light mode, wherein said power-switching means comprises said power-source chamber being adapted to permit said power source to reciprocally translate therein from an open light-on mode to a closed light-off mode; and e. a housing covering said cartridge and said lid such that water-tight integrity is maintained within.

32. The device as defined in claim 31 further comprising a cavity within said housing.

33. The device as defined in claim 32 wherein said cavity contains a filler being clear, translucent, a plurality of colors, or any combination thereof.

34. The device as defined in claim 32 wherein said cavity contains a filler of sufficient density as to impart a negative buoyancy to said device.

35. The device as defined in claim 32 wherein said cavity contains a filler adapted to retain heat when said device is heated.

36. The device as defined in claim 32 wherein said cavity contains a filler adapted to retain cold when said device is cooled.

37. The device as defined in claim 31 further comprising holding means for holding display objects, said holding means on an inside surface of said housing.

38. The device as defined in claim 31 wherein said lid chamber has a transparent bottom.

39. The device as defined in claim 31 wherein said power-source chamber further comprises a power-source restrictive means for preventing unintended translation of said power source within said power-source chamber.

40. The device as defined in claim 31 further comprising a support means seated in said lid chamber for supporting said power source, said support means further comprising indicia on a side exposable to a bottom of said lid chamber.

41. The device as defined in claim 40 wherein said support means comprises a bias member between the inside surface of said lid and said power source.

42. The device as defined in claim 41 wherein said bias member comprises hook or a loop of a hook-and-loop fastener.

43. The device as defined in claim 41 wherein said bias member comprises a corrugated plate.

44. The device as defined in claim 40 wherein said support means comprises a foam-like resilient member.

* * * * *